US007153152B1

(12) United States Patent
Eby et al.

(10) Patent No.: US 7,153,152 B1
(45) Date of Patent: Dec. 26, 2006

(54) ELECTRICAL CONNECTOR WITH PLANAR CONTACT ENGAGING SURFACE

(75) Inventors: Richard L. Eby, Marshfield, MA (US); Urs F. Nager, Jr., Hudson, NH (US)

(73) Assignee: Anderson Power Products, Sterling, MA (US)

( * ) Notice: Subject to any disclaimer, the term of this patent is extended or adjusted under 35 U.S.C. 154(b) by 1087 days.

(21) Appl. No.: 08/908,872

(22) Filed: Aug. 8, 1997

(51) Int. Cl.
*H01R 25/00* (2006.01)

(52) U.S. Cl. ..... 439/295

(58) Field of Classification Search ..... 439/295, 439/293, 839
See application file for complete search history.

(56) References Cited

U.S. PATENT DOCUMENTS 206,154 A * 9/1878 Walker et al. ..... 439/293
3,011,143 A * 11/1961 Dean ..... 439/293
4,083,617 A * 4/1978 Wyatt ..... 439/295
4,537,456 A * 8/1985 Brown et al. ..... 439/293
5,685,748 A * 11/1997 Harting et al. ..... 439/839

FOREIGN PATENT DOCUMENTS

JP 404112465 * 4/1992 ..... 439/295

* cited by examiner

*Primary Examiner*—J. F. Duverne
(74) *Attorney, Agent, or Firm*—Maine & Asmus

(57) ABSTRACT

An electrical connector has a housing within which is mounted a genderless electrical contact. The electrical contact has a longitudinal axis, a proximal end and a distal end. The distal end has a planar electrical contact engaging surface with the plane thereof intersecting the contact's longitudinal axis at a predetermined angle. The genderless electrical connector is positionally maintained within the housing so that repeatable electrical engagement can be achieved with a planar electrical contact engaging surface of a corresponding genderless electrical contact.

11 Claims, 10 Drawing Sheets

| RATE OF CONNECTION MAXIMUM m/sec | CONTACT CONNECTION ANGLE degrees |
|---|---|
| 1 | 39 |
| 3 | 30 |
| 5 | 25 |
| 10 | 13.5 |
| 15 | 8 |

ELECTRICAL CONNECTOR WITH PLANAR CONTACT ENGAGING SURFACE

BACKGROUND OF THE INVENTION

The present invention relates to electrical connectors in general and, more particularly, to a genderless electrical contact having a planar electrical contact engaging surface.

Genderless electrical connectors are well known in the art. Representative examples of such connectors include the connectors manufactured and sold by the Anderson Power Product Division of High Voltage Engineering Corporation under the registered trademarks SB® and PowerPole®. The construction of the SB® electrical connector is shown in U.S. Pat. No. 3,909,099 issued Sep. 30, 1975 to Edward D. Winkler for "Electrical Connector With Movably Mounted Cable Clamp". The subject matter of U.S. Pat. No. 3,909,099 is incorporated herein in its entirety by reference. The construction of the PowerPole® electrical connectors is shown in U.S. Pat. No. 3,259,870 issued Jul. 5, 1966 to Edward D. Winkler for "Electrical Connector". The subject matter of U.S. Pat. No. 3,259,870 is incorporated herein in its entirety by reference.

The Winkler electrical connectors employ a rigid terminal member or contact that is attached to a wire lead by soldering or crimping. The contact itself is mounted within a housing under a spring load. The contact normally has an arcuate distal end so that it will engage with a corresponding electrical contact with the arcuate ends overriding each other to a detent position.

This general type of genderless electrical contact also has been manufactured and sold with a planar distal surface and an arcuate distal end i.e., the SB®-50 and PowerPole®-75 electrical connectors. However, these connectors were not designed to maintain, nor did they maintain, the positional integrity of the electrical contact within the housing. The electrical contact was free to move within the housing so that initial electrical surface contact with another electrical contact varied in terms of where the initial contact actually occurred on the contact surfaces. This was not a problem because the connector was UL and CSA rated for disconnect use only.

With the advent of uninterruptable power supplies, the need has arisen for "hot swapable" power supplied for rechargeable batteries. The instantaneous "inrush" electrical current flow upon connection to a UPS circuit having capacitive/reactive components is well above the steady state current load after the component(s) have been charged. At this current level, arcing of the electrical connector contacts creates a significant problem with welding of the electrical contacts a not infrequent occurrence.

It is, accordingly, a general object of the invention to provide an improved genderless electrical connector for connect disconnect use under load.

It is a specific object of the invention to provide genderless electrical contacts that minimize contact "bounce".

It is another object of the invention to provide an electrical connector having a genderless electrical contact with a planar contact engaging surface that is positionally maintained to provide repeatable mating with the planar contact engaging surface of a corresponding electrical connector.

BRIEF SUMMARY OF THE INVENTION

A genderless electrical contact has a planar electrical contact engaging surface. The plane of the surface intersects the longitudinal axis of the contact at a predetermined angle in the range of 8° to 39° inclusive. The electrical contact is mounted within a housing and is positionally maintained therein so that the contact will engage with another planar electrical contact engaging surface so that the two planar surfaces are substantially parallel to each other at the moment of physical and electrical contact.

DETAILED DESCRIPTION OF A PREFERRED EMBODIMENT

Figure 1:
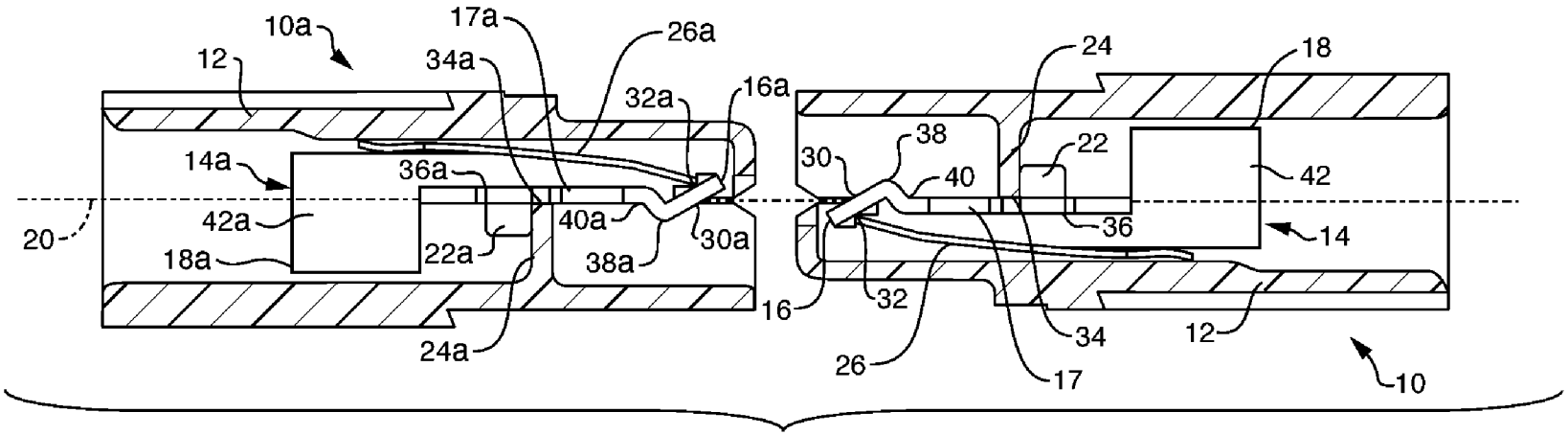
FIG. 1 is a diagrammatic view in section of two matable genderless electrical connectors with planar electrical contacting surfaces on the connector contacts.
Figure 2:
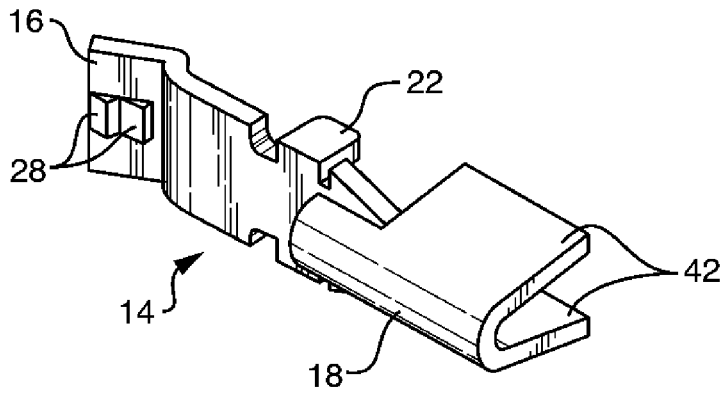
FIG. 2 is a wire frame drawing of the electrical contact.
Figure 3:
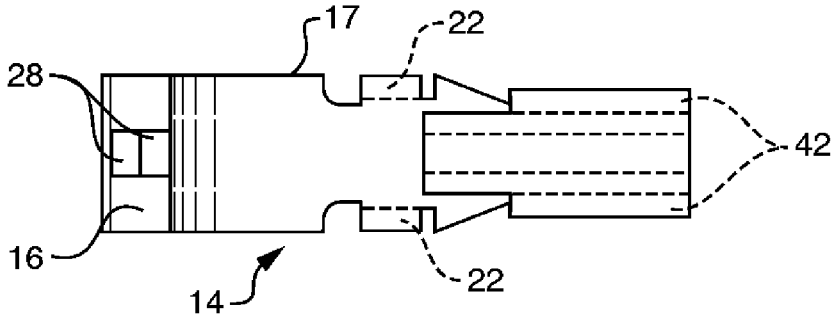
FIG. 3 is a plan view of the electrical contact.

Turning now to the drawings, and particularly to FIGS. 1–3, there is shown an electrical connector 10 of the type described in detail in the aforementioned U.S. Pat. No. 3,259,870. Electrical connector 10 has a housing 12 within which is mounted a genderless electrical contact 14 having a distal end 16, a proximal end 18 and a longitudinal axis 20. Upstanding tabs 22 are formed in the connector and provide a mechanical stop with wall section 24 of housing 12 to prevent movement of the contact to the left as viewed in FIG. 1. A leaf spring 26 is staked to the housing 12 and provides a spring loading to electrical contact 12 as it bears against projections 28 formed on the underside of the distal end 16.

Figure 4:
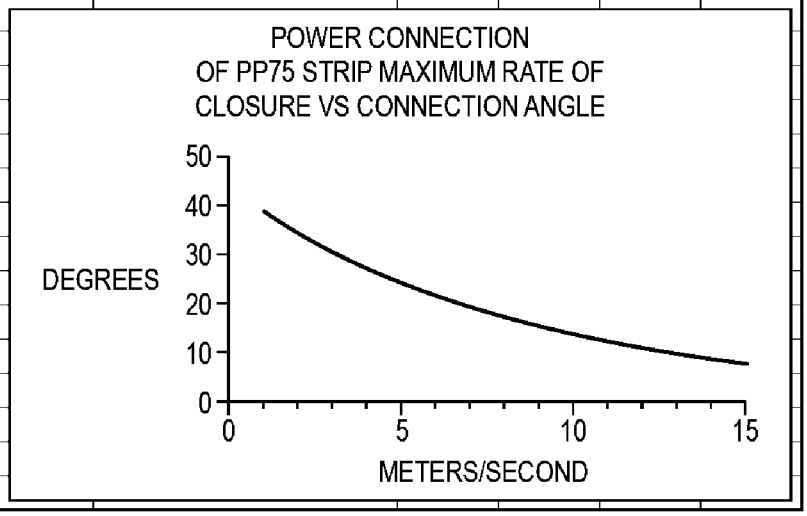
FIG. 4 is a graph showing the maximum rate of closure vs connection angle for the planar surface electrical contacts.

The distal end 16 has a planar electrical contact engaging surface 30, the plane of which intersects the longitudinal axis 20 at a predetermined angle within the range of 8 to 39 degrees inclusive. The angle of intersection is determined by the rate of closure of connector 10 with respect to a corresponding connector 10*a*. The graph of FIG. 4 illustrates the maximum rate of closure versus the connection angle i.e., the intersection of the planar surface plan with the longitudinal axis 20.

It will be appreciated that the combination of the staked leaf spring 26 and the mechanical stop formed by tabs 22 and housing wall 22 accurately position and maintain the position of the electrical contact 14 within housing 12. Movement of the electrical connector along longitudinal axis 20 is prevented by this combination.

The angular position of the plane of the planar electrical contact engaging surface with respect to the longitudinal axis is maintained by three contact points 32, 34 and 36. Lateral movement is constrained by the width of the distal end 16.

By accurately positioning and maintaining the position of the planar electrical contact engaging surface 30, the surface will be substantially parallel to the planar surface 30*a* of the other electrical connector 10*a* at the moment of physical and electrical contact. The degree of departure from parallelism should not exceed 3 degrees with respect to the longitudinal axis 20. With this configuration, both contact bounce and arcing are minimized.

Further engagement of the two electrical connectors 10 and 10*a* positions arcuate contact portions 38 and 38*a* in respective detents 40 and 40*a* under spring loaders provided by leaf springs 26 and 26*a* in overlapped arrangement (see, for example, FIG. 4 of U.S. Pat. No. 3,259,870).

The electrical contacts 14 and 14*a* incorporate two upstanding tabs 42 for connection to a wire or wires (not shown). Other forms of wire or circuit connections are depicted in FIGS. 5 through 10.

Figure 5A:
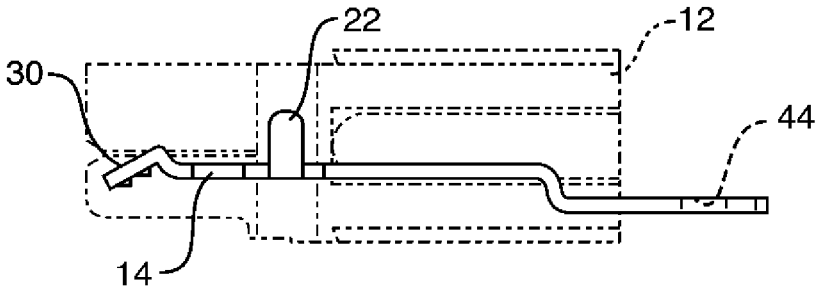
FIGS. 5*a*, 5*b* and 5*c* are, respectively, side, plan and end views of an electrical contact for buss use.
Figure 5B:
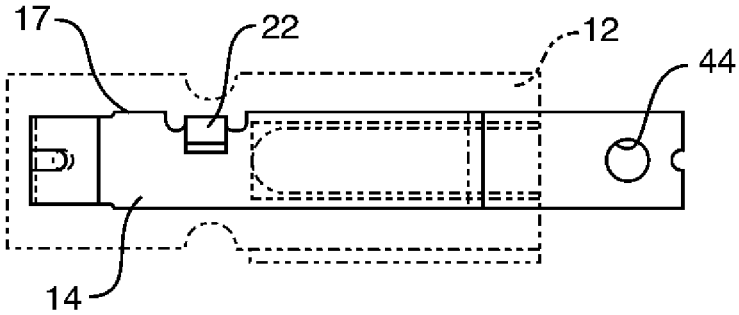
Figure 5C:
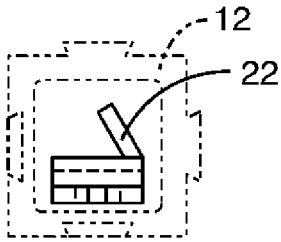
Figure 6A:
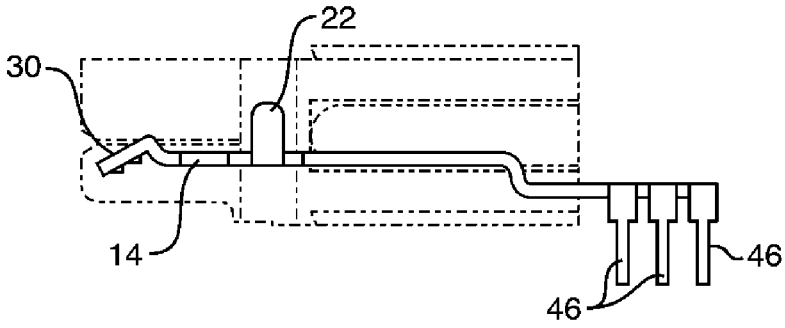
FIGS. 6*a*, 6*b* and 6*c* are, respectively, side, plan and end views of an electrical contact for printed circuit board use.
Figure 6B:
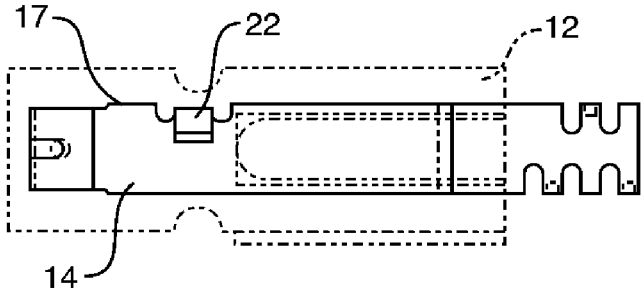
Figure 6C:
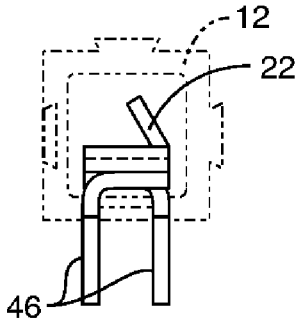

FIGS. 5*a*–5*c* and FIGS. 6*a*–6*c* each show in side, plan and end views variations on the connection to a wire(s) or circuit. FIGS. 5*a*–5*c* illustrate a buss type connection with a fastener aperture 44 while FIGS. 6*a*–6*c* depict printed circuit board connections 46. In each drawing, housing 12 is shown by the dashed lines.

FIGS. 7*a*–7*c* through 10*a*–10*c* illustrate in partial section an electrical connector of the type shown in U.S. Pat. No. 3,909,099 and sold under the registered trademark SB®. While the housing 48 is different from the housing 12, the electrical contacts 14 have the previously mentioned planar electrical contact engaging surfaces 30 and are positionally maintained within the housing by tabs 22 and a corresponding leaf spring (not shown).

Figure 7A:
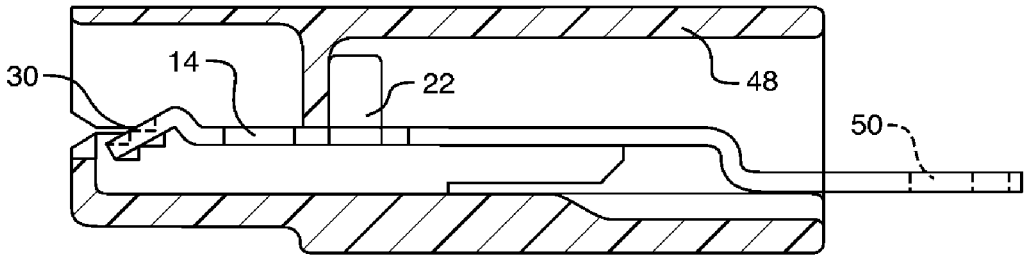
FIGS. 7*a*, 7*b* and 7*c* are, respectively, side, plan and end views of an electrical connector and electrical contacts for buss use with FIGS. 7*a* and 7*b* shown in partial section.
Figure 7B:
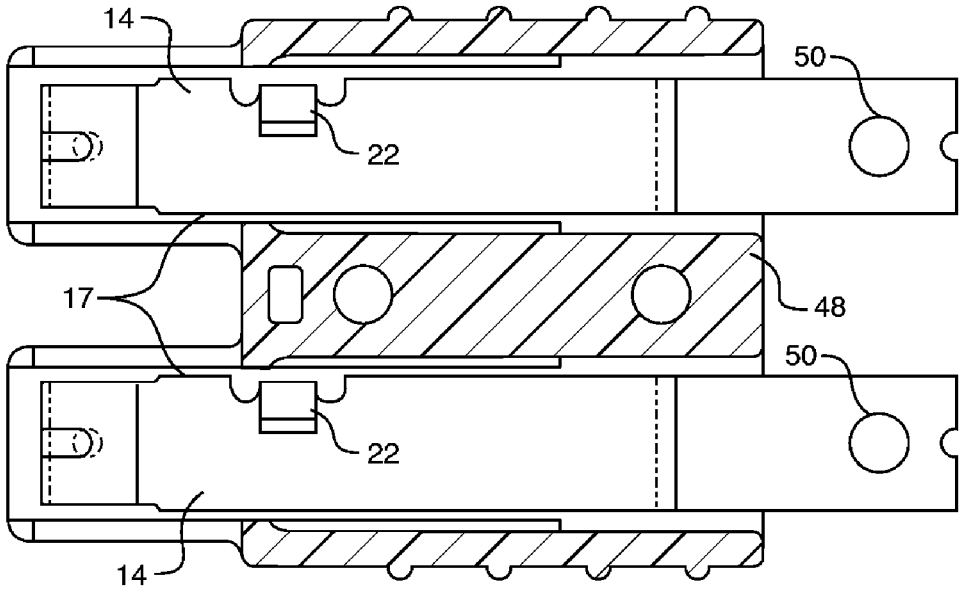
Figure 7C:
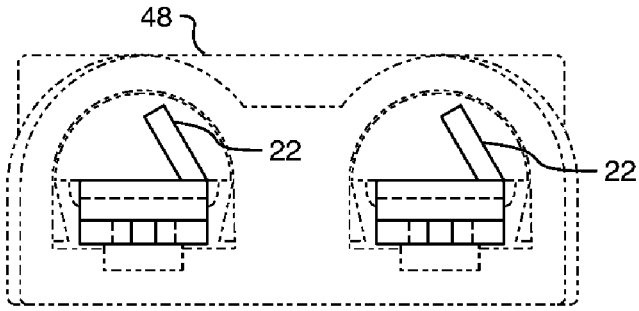
Figure 8A:
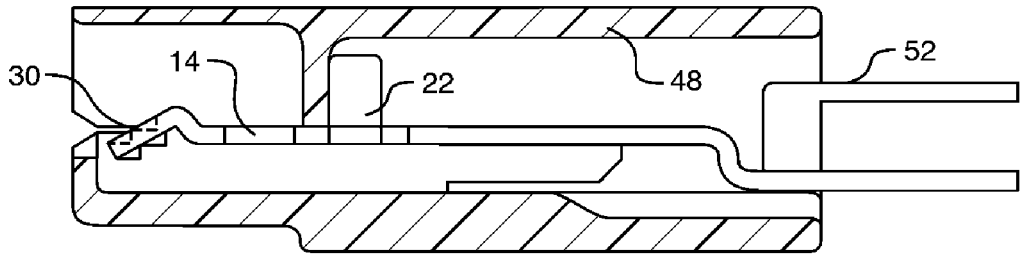
FIGS. 8*a*, 8*b* and 8*c* are, respectively, side, plan and end views of an electrical connector and vertical electrical contacts with FIGS. 8*a* and 8*b* shown in partial section.
Figure 8B:
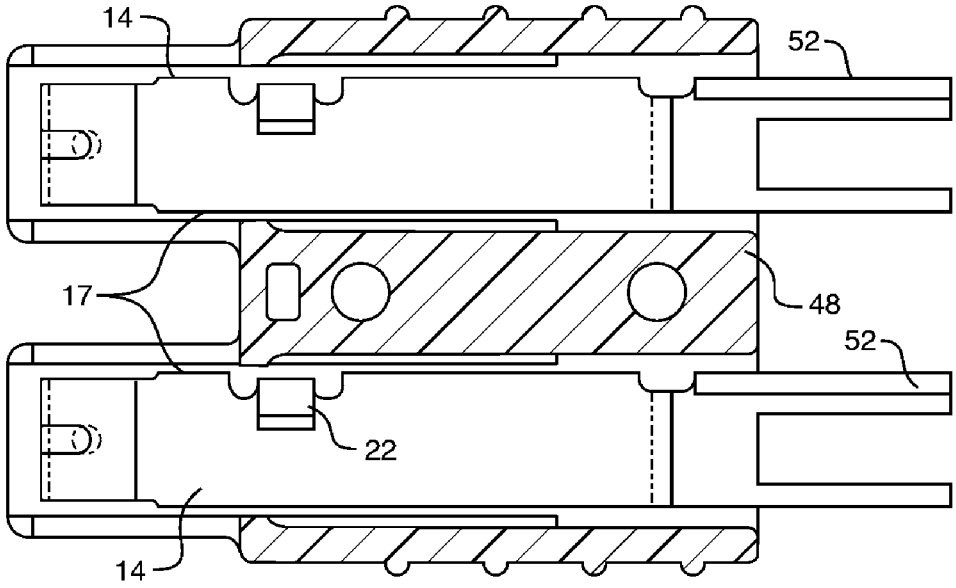
Figure 8C:
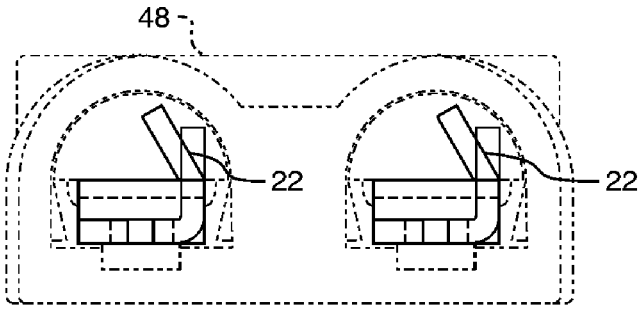
Figure 9A:
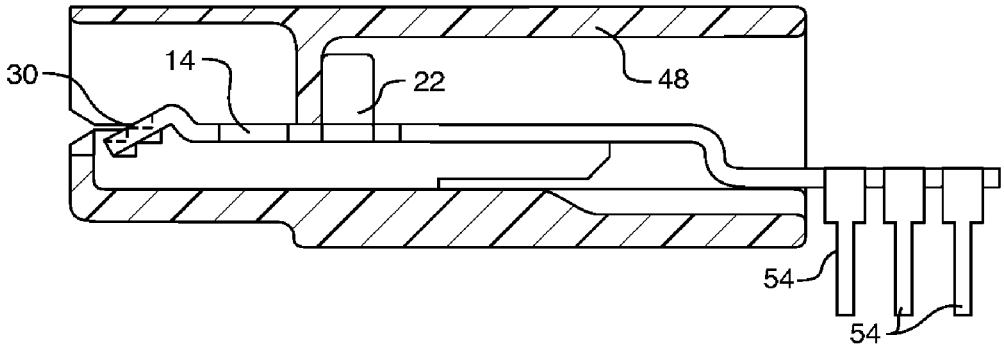
FIGS. 9*a*, 9*b* and 9*c* are, respectively, side, plan and end views of an electrical connector and electrical contacts for use with printed circuit boards and with FIGS. 9*a* and 9*b* shown in partial section.
Figure 9B:
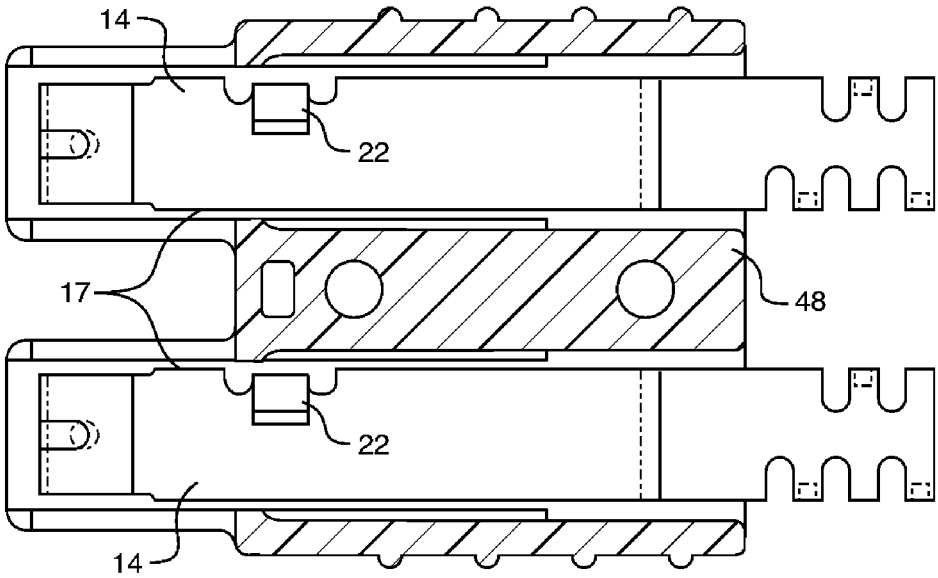
Figure 9C:
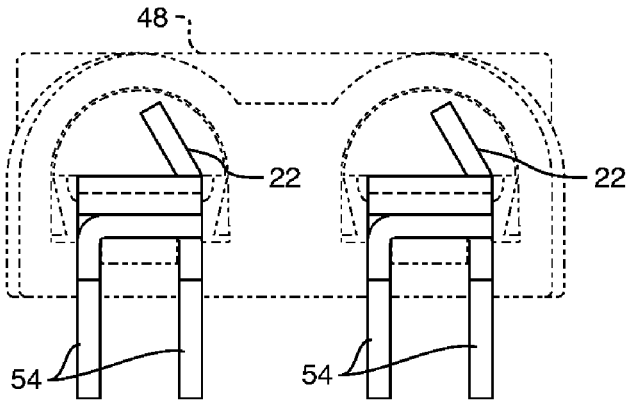
Figure 10A:
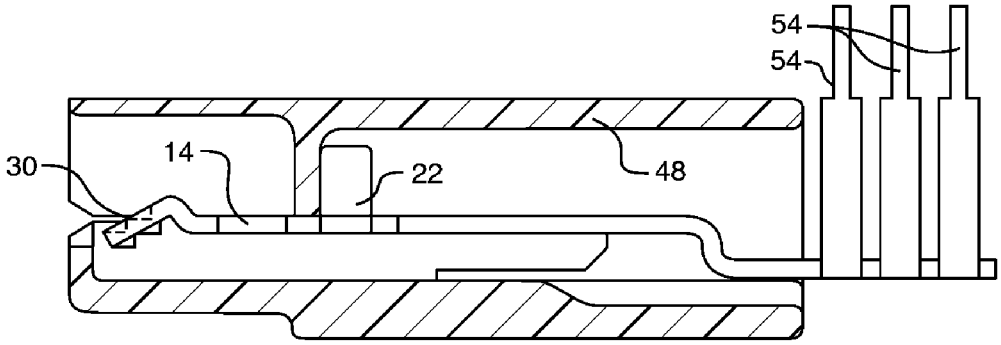
FIGS. 10*a*, 10*b* and 10*c* are, respectively, side, plan and end views of an electrical connector and electrical contacts with FIGS. 10*a* and 10*b* shown in partial section; and, FIG. 11 is a plan view of a contact strip showing three of many contacts joined together by a web between contacts.
Figure 10B:
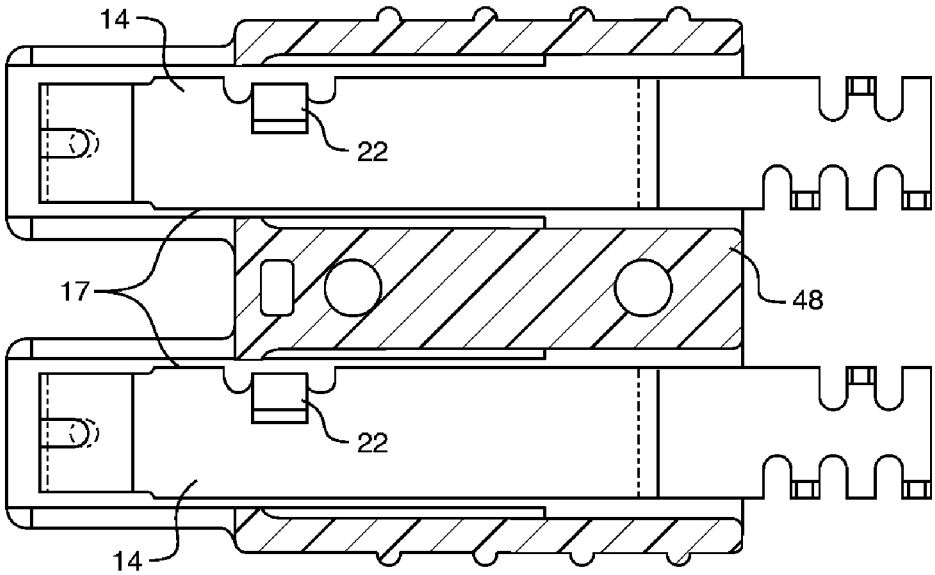
Figure 10C:
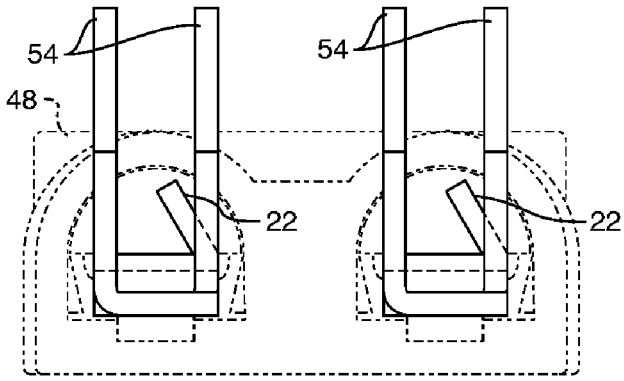

FIGS. 7*a*–7*b* depict the electrical contact with a buss connection with aperture 50 provided for a fastener. FIGS. 8*a*–8*c* illustrate another configuration of the electrical connection using vertical contacts 52.

FIGS. 9*a*–9*c* and FIGS. 10*a*–10*c* show printed circuit board contacts 54 in two different arrangements.

Figure 11:
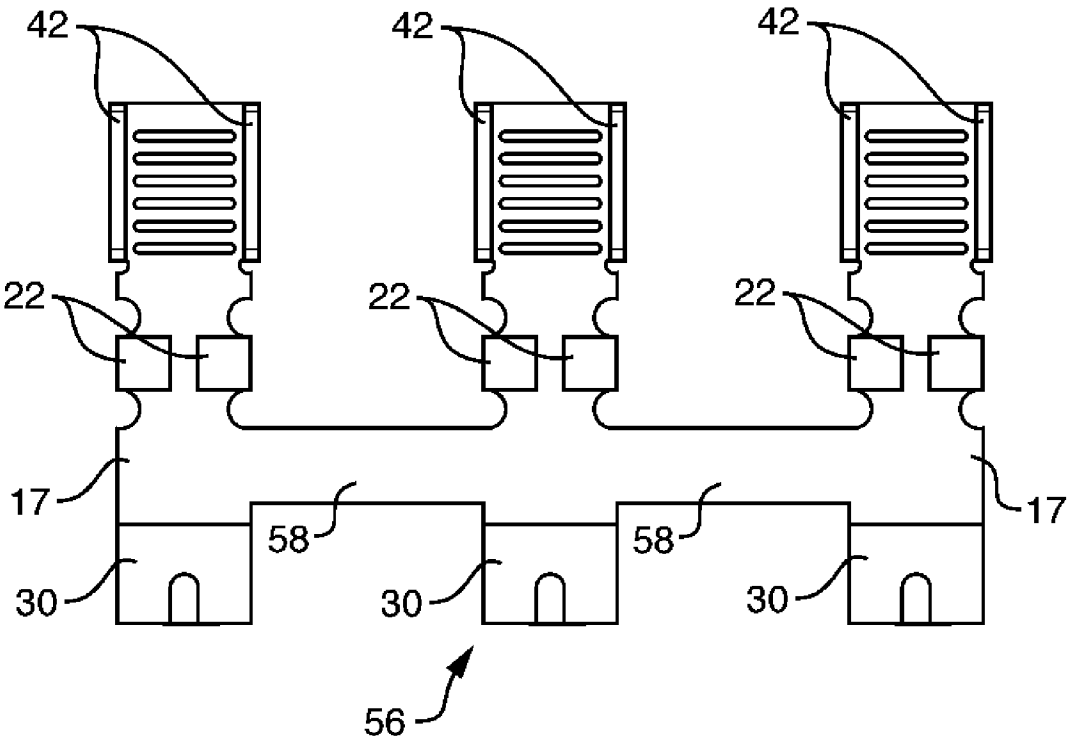

FIG. 11 shows in plan view a strip 56 of the contacts 14 joined together at their intermediate portions 17 by a web 58. In this configuration the contacts are suitable for machine crimping assembly to wires (not shown).

Having described in detail a preferred embodiment of the invention, it will now be apparent that numerous modifications can be made without departing from the scope of the following claims.

We claim:

1. An electrical connector comprising:

a housing;

a rigid genderless electrical contact mounted within said housing, said rigid genderless electrical contact having a longitudinal axis, a proximal end and distal end, said distal end terminating in a planar electrical contact engaging surface with the plane thereof intersecting the longitudinal axis at a predetermined angle, said planar electrical contact engaging surface being positionally maintained within said housing to permit repeatable electrical engagement with a planar electrical contact engaging surface of a corresponding rigid genderless electrical contact; and a spring element mounted within said housing and bearing against said rigid genderless electrical contact to spring load the rigid genderless electrical contact.

2. The electrical connector of claim 1 wherein the plane of said planar electrical contact engaging surface intersects the longitudinal axis at an predetermined angle in the range of 8 to 39 degrees inclusive.

3. An electrical connector comprising:

a housing;

a rigid genderless electrical contact mounted within said housing, said rigid genderless electrical contact having a longitudinal axis, a proximal end and distal end, said distal end terminating in a planar initial electrical contact engaging surface portion with the plane thereof intersecting the longitudinal axis at a predetermined angle and an arcuate final electrical contact engaging surface portion, said initial and final electrical contact engaging surface portions being positionally maintained within said housing to permit repeatable electrical engagement with planar initial and arcuate final electrical contact engaging surface portions, respectively, of a corresponding rigid genderless electrical contact; and a spring element mounted within said housing and bearing against said rigid genderless electrical contact to spring load the rigid genderless electrical contact.

4. The electrical connector of claim 3 wherein the plane of said planar initial electrical contact engaging surface intersects the longitudinal axis at an predetermined angle in the range of 8 to 39 degrees inclusive.

5. The electrical connector of claim 3 wherein said rigid genderless electrical contact includes an electrical conductor engaging element.

6. The electrical connector of claim 3 wherein said housing also is genderless so that the electrical connector can mate with another electrical connector having a corresponding rigid genderless housing and a rigid genderless electrical contact.

7. An electrical connector assembly comprising:

a first electrical connector comprising:

a housing; and, a rigid genderless electrical contact mounted within said housing, said rigid genderless electrical contact having a longitudinal axis, a proximal end and distal end, said distal end terminating in a planar electrical contact engaging surface portion with the plane thereof intersecting the longitudinal axis at a predetermined angle;

a second electrical connector comprising:

a housing; and, a rigid genderless electrical contact mounted within said housing, said rigid genderless electrical contact having a longitudinal axis, a proximal end and distal end, said distal end terminating in a planar electrical contact engaging surface portion with the plane thereof intersecting the longitudinal axis at a predetermined angle;

said first and second electrical connector rigid genderless electrical contacts being electrically engagable with each other with the planes of the planar electrical contact engaging surface portions intersecting the longitudinal axes at substantially the same predetermined angle and with the planar electrical contact engaging surface portions being postionally maintained within their respective housings so that said planar electrical contact engaging surface portions are substantially parallel at the moment of their electrical engagement thereby permitting repeatable electrical engagement with minimal contact bounce thereof.

8. An electrical connector assembly comprising:

a first electrical connector comprising:

a housing; and a rigid genderless electrical contact mounted within said housing, said rigid genderless electrical contact having a longitudinal axis, a proximal end and distal end, said distal end terminating in a planar initial electrical contact engaging surface portion with the plane thereof intersecting the longitudinal axis at a predetermined angle and an arcuate final electrical contact engaging surface portion;

a second electrical connector comprising:

a housing; and, a rigid genderless electrical contact mounted within said housing, said rigid genderless electrical contact having a longitudinal axis, a proximal end and distal end, said distal end terminating in a planar initial electrical contact engaging surface portion with the plane thereof intersecting the longitudinal axis at a predetermined angle and an arcuate final electrical contact engaging surface portion;

said first and second electrical connector rigid genderless electrical contacts being electrically engagable with the planes of the planar initial electrical contact engaging surface portions intersecting the longitudinal axes at substantially the same predetermined angle and with the planar initial electrical contact engaging surface portions being positionally maintained within their respective housings so that said planar initial electrical contact engaging surface portions are substantially parallel at the moment of their electrical engagement thereby permitting repeatable electrical engagement with minimal contact bounce thereof.

9. The electrical connector assembly of claim 8 wherein the magnitude of the predetermined angle of intersection of the planes with the longitudinal axes is established as a function of a predetermined rate of closure of the planar initial electrical contact engaging surface portions during electrical engagement thereof.

10. The electrical connector assembly of claim 9 wherein the magnitude of the predetermined angle of intersection of the planes with the longitudinal axes decreases as the rate of closure of the planar initial electrical contact engaging surface portion increases.

11. The electrical connector assembly of claim 10 wherein the magnitude of the predetermined angle of intersection of the planes with the longitudinal axes is established in accordance with the following table:

| Predetermined angel (degrees) (meters/sec) | Rate of Closure |
|---|---|
| 39 | .1 to .1 |
| 30 | .1 to 3 |
| 25 | .1 to 5 |
| 13.5 | .1 to 10 |
| 8 | .1 to 15. |

* * * * *